US011583093B2

(12) United States Patent
Liang

(10) Patent No.: US 11,583,093 B2
(45) Date of Patent: Feb. 21, 2023

(54) CHAIR WITH BACK SUPPORT GUIDING ARRANGEMENT

(71) Applicant: Jian Liang, Walnut, CA (US)

(72) Inventor: Jian Liang, Walnut, CA (US)

( * ) Notice: Subject to any disclaimer, the term of this patent is extended or adjusted under 35 U.S.C. 154(b) by 18 days.

(21) Appl. No.: 17/322,850

(22) Filed: May 17, 2021

(65) Prior Publication Data

US 2022/0361678 A1 Nov. 17, 2022

(51) Int. Cl.
*A47C 7/62* (2006.01)

(52) U.S. Cl.
CPC ..... *A47C 7/62* (2013.01)

(58) Field of Classification Search
CPC ..... A47C 7/62; A47C 7/622; A47C 7/624; A47C 7/626; A47C 7/628
USPC ..... 248/345.1
See application file for complete search history.

(56) References Cited

U.S. PATENT DOCUMENTS 3,289,219 A * 12/1966 Ferneau ..... A61G 5/006 296/20
10,512,331 B2 * 12/2019 Zhang ..... A47C 7/748

* cited by examiner

*Primary Examiner* — Nkeisha Smith
(74) *Attorney, Agent, or Firm* — Tsz Lung Yeung

(57) ABSTRACT

A chair includes a seat support, a leg frame extended underneath the seat support, a back support upwardly extended from the seat support, and a back support guiding arrangement. The back support guiding arrangement includes a guiding wheel rotatably mounted on a rear side of the back support for biasing against an external object so that when the back support of the chair accidentally hits the external object, the guiding wheel is arranged to act as a buffer to minimize damage imparted on the external object.

2 Claims, 6 Drawing Sheets

CHAIR WITH BACK SUPPORT GUIDING ARRANGEMENT

BACKGROUND OF THE PRESENT INVENTION

Field of Invention

The present invention relates to a chair, and more particularly to a chair comprising a back support guiding arrangement which is capable of preventing a back support accidentally hitting an external object from severely damaging it.

Description of Related Arts

A conventional chair usually includes a seat, a back support upwardly extended from the seat, and a leg frame extended underneath the seat for suspendedly supporting the seat and the back support. Very often, the chair usually comprises a plurality of wheels provided on the leg frame for supporting the entire in a rotatably movable manner.

When a person sits on the chair, the chair may move according to user's preferences. However, there exist a situation where when a user leans backward while he is sitting on the chair, the back support of the chair may accidentally hit the object (such as a wall surface) behind the back support. When this happens too frequently, the object hit by the back support may suffer noticeable or considerable physical damages. For example, a wall surface frequently hit by the back support may be damaged physically as well as aesthetically.

As a result, there is a need to develop a chair which may minimize or prevent the back support of a chair from severely damaging an external object when it is accidentally hit by the back support.

SUMMARY OF THE PRESENT INVENTION

Certain variations of the present invention provide a chair comprising a back support guiding arrangement which is capable of preventing a back support accidentally hitting an external object (such as a wall surface) from severely damaging it.

Certain variations of the present invention provide a chair comprising a back support guiding arrangement, wherein the back support guiding arrangement comprises at least one guiding wheel provided at a rear side of a back support so as to act as a buffer for diverting the force imparted on an external object when the back support accidentally hits the external object.

In one aspect of the present invention, it provides a chair, comprising:

a seat support;

a leg frame extended underneath the seat support;

a back support upwardly extended from the seat support; and a back support guiding arrangement which comprises a guiding wheel rotatably mounted on a rear side of the back support for biasing against an external object so that when the back support of the chair accidentally hits the external object, the guiding wheel is arranged to act as a buffer to minimize damage imparted on the external object.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiments is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection. Furthermore, "connected" may also mean direct connection or indirect connection, or connection through other auxiliary components. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Figure 1:
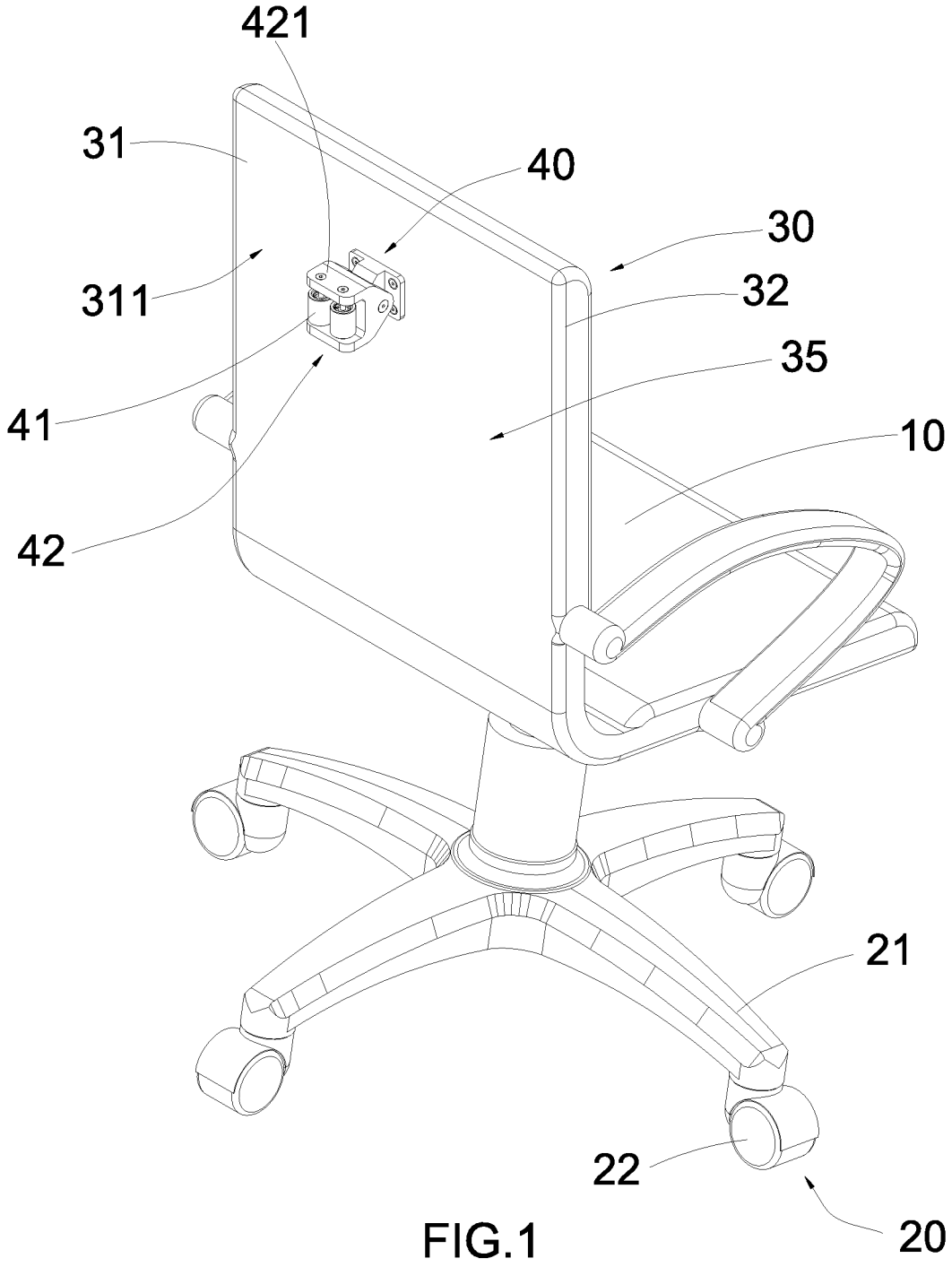
FIG. 1 is a perspective view of a chair according to a preferred embodiment of the present invention.
Figure 2:
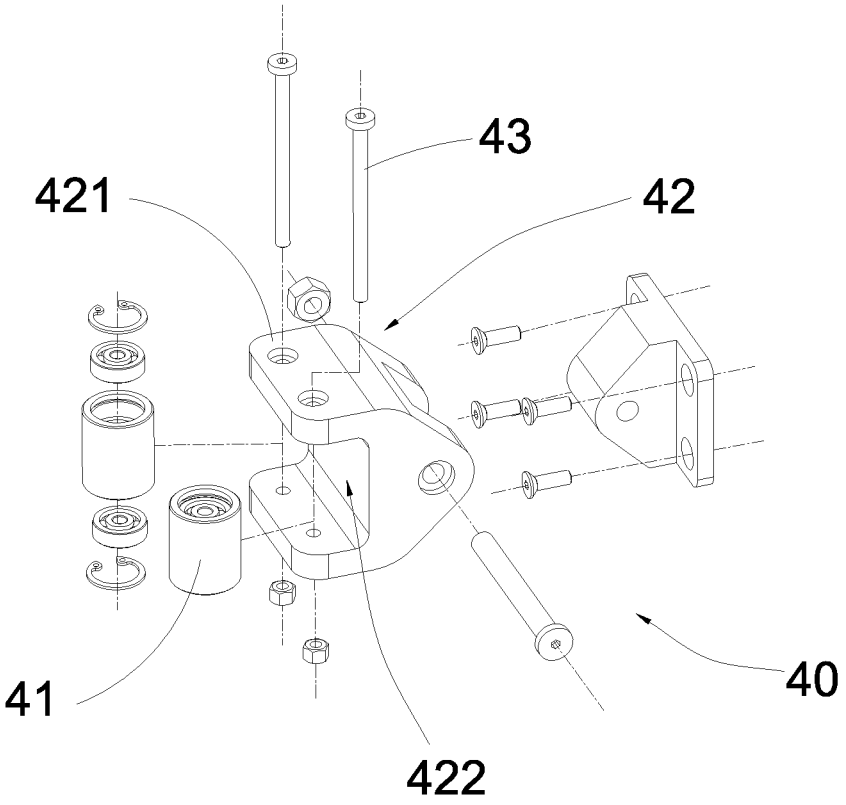
FIG. 2 is an exploded perspective view of a back support guiding arrangement of the chair according to the preferred embodiment of the present invention.

Referring to FIG. 1 to FIG. 2 of the drawings, a chair according to a preferred embodiment of the present invention is illustrated. The chair may allow a person to sit thereon. Broadly, the chair may comprise a seat support 10, a leg frame 20 extended underneath the seat support 10, a back support 30 upwardly extended from the seat support 10, and a back support guiding arrangement 40.

The back support guiding arrangement 40 may comprises at least one guiding wheel 41 rotatably mounted on a rear side 35 of the back support 30 for biasing against an external object so that when the back support 30 of the chair accidentally hits the external object, the guiding wheel 41 is arranged to act as a buffer to minimize damage imparted on the external object.

According to the first preferred embodiment of the present invention, the seat support 10 may be arranged to support a weight of the person sitting on the chair. The seat support 10 may be configured to have a cushion layer, a fabric layer, or a rigid layer (such as a wood panel) for allowing the person to sit thereon.

The leg frame 20 may be mounted underneath the seat support 10. The leg frame 20 may comprise a plurality of leg members 21 arranged to stand on the ground. Moreover, the leg frame 20 may further comprise a plurality of leg wheels 22 attached on a bottom portion of the leg members 21 respectively for rotatably supporting the chair of the present invention.

The back support 30 may be attached on the seat support 10 and may upwardly extend therefrom. The back support 30 may comprise a back support frame 31 and a back support member 32 attached on the back support frame 31. The back support member 32 may be configured to have a cushion layer, a fabric layer, or a rigid layer (such as a wood panel) for allowing a user to lean thereon when he is sitting on the seat support 10. The back support 30 may be movably mounted on the seat support 10 so that the back support 30 may pivotally move with respect to the seat support 10. In some variations, the back support frame 31 may be embedded in the back support member 32.

The back support guiding arrangement 40 may be mounted on the rear side 35 of the back support 30. Specifically, the back support guiding arrangement 40 may further comprise a mounting bracket 42 provided on the rear surface 311 of the back support 30, wherein the guiding wheel 41 may be rotatably mounted to the mounting bracket 42. The rear surface 311 of the back support 30 may be formed on either the back support frame 31 or the back support member 32, depending on the exact configuration of the back support 30. For example, as shown in FIG. 1 of the drawings, the mounting bracket 42 may be attached on the back support frame 31.

It is worth mentioning that the mounting bracket 42 may be sized and shaped to take a wide variety of forms. In the preferred embodiment of the present invention, the mounting bracket 42 may comprise a bracket housing 421 mounted on the rear surface 311 of the back support frame 31, and an accommodating cavity 422 formed in the bracket housing 421. The guiding wheel 41 may be rotatably supported in the accommodating cavity 422 through a guiding shaft 43. In other words, the guiding wheel 41 may be rotated about the guiding shaft 43. Moreover, each of the guiding wheels 41 may also move along an axial direction of the corresponding guiding shaft 43 within the accommodating cavity 422.

According to the preferred embodiment of the present invention, the back support guiding arrangement 40 may comprise two guiding wheels 41 accommodated in the accommodating cavity 422 in a side-by-side manner. Each of the guiding wheels 41 may be rotatably mounted on a corresponding guiding shaft 43 in such a manner that each of the guiding wheels 41 may also move linearly with respect to the corresponding guiding shaft 43 (i.e. along a longitudinal direction thereof). Thus, each of the guiding wheels 41 may move upwardly or downwardly along the corresponding guiding shaft 43 when the guiding shaft 43 is mounted in the bracket housing 421 such that the guiding shaft 43 is vertically mounted with respect to the back support frame 31.

Referring to FIG. 2 of the drawings, the back support guiding arrangement 40 may comprise two guiding wheels 41 rotatably mounted in the bracket housing 421 and may be arranged to be side-by-side with each other. Each of the guiding wheels 41 may be partially received in the accommodating cavity 422 so that part of the guiding wheels 41 may be exposed out of the accommodating cavity 422 and come into contact with the external object when the back support 30 biases against the external object.

In the configuration shown in FIG. 2 of the drawings, when the back support 30 of the chair accidentally hits the external object such as a wall surface, the guiding wheels 41 may come into contact with the external object. Since the guiding wheels 41 is rotatable and movable, the accidental hitting force exerted by the back support 30 on the external object may largely be converted into forces which may drive the guiding wheels 41 to rotate or move with respect to the bracket housing 421. As a result, the force may largely be diverted and this may minimize or prevent the accidental hitting impact from damaging the external object.

Figure 3:
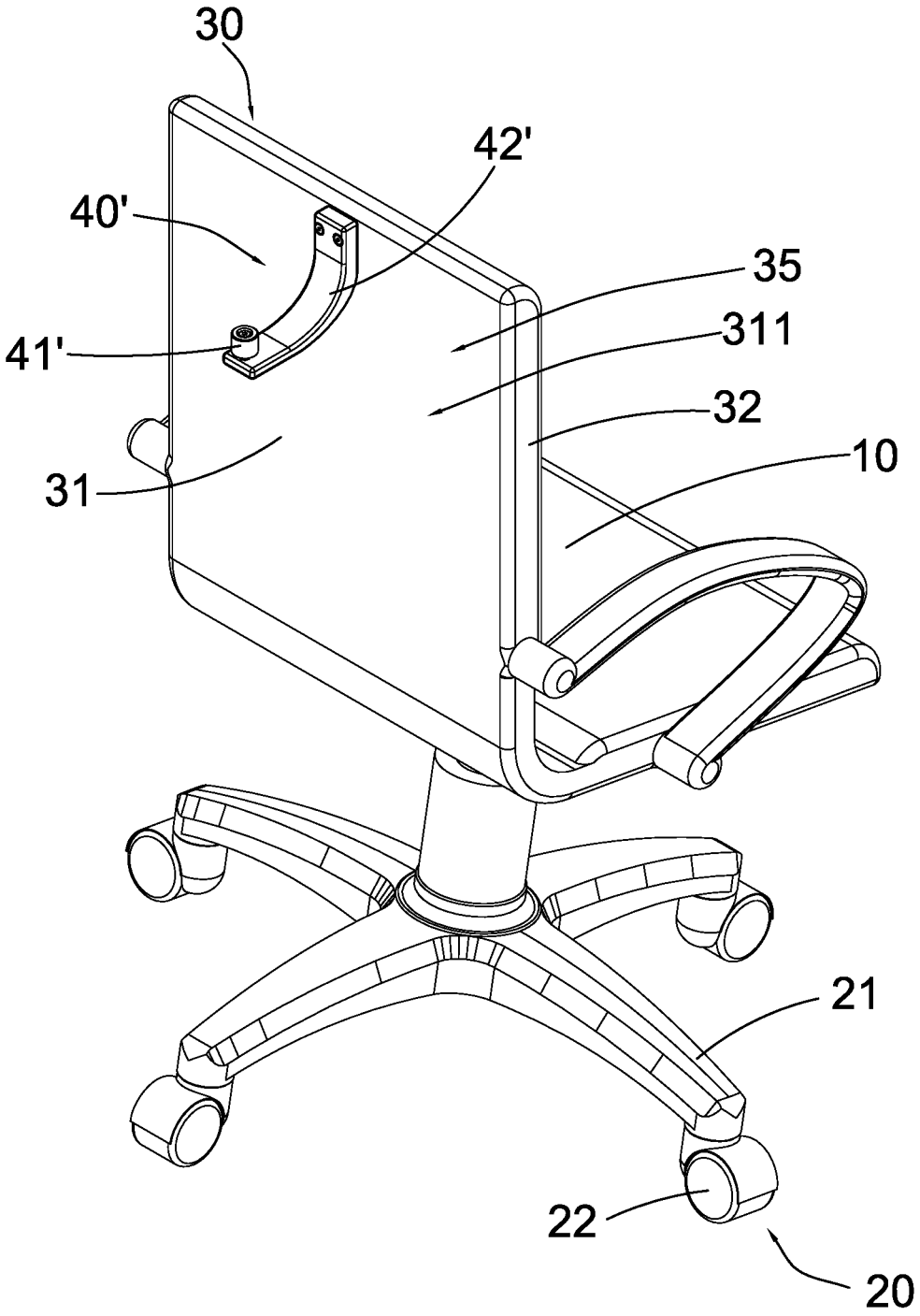
FIG. 3 is a first alternative mode of the chair according to the preferred embodiment of the present invention.
Figure 4:
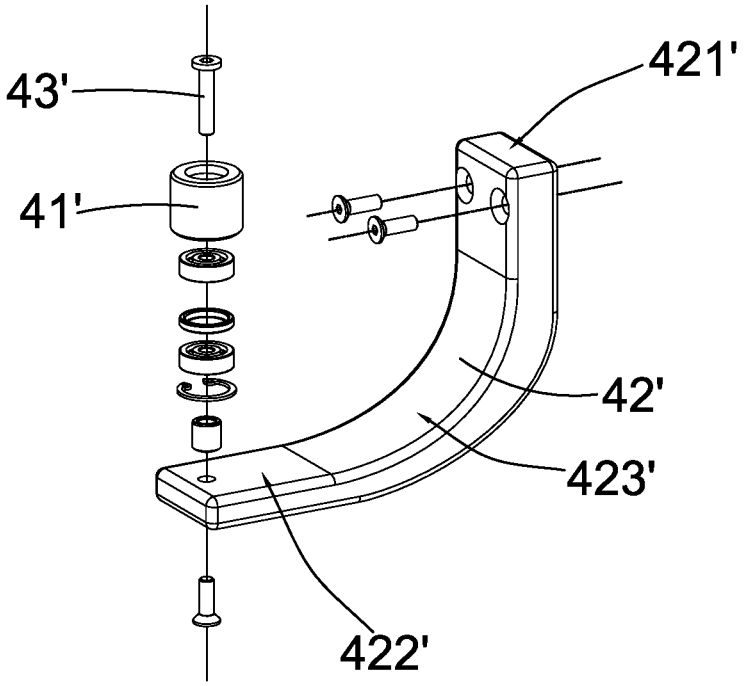
FIG. 4 is an exploded perspective view of a back support guiding arrangement of the chair according to the first alternative mode of the preferred embodiment of the present invention.

Referring to FIG. 3 to FIG. 4 of the drawings, a first alternative mode of the chair according to the preferred embodiment of the present invention is illustrated. The first alternative mode is very similar to the preferred embodiment. The only difference between the preferred embodiment and the first alternative is the back support guiding arrangement 40'. According to the first alternative mode, the back supporting guiding arrangement 40' may comprise at least one guiding wheel 41' and a mounting bracket 42' mounted on the rear surface 311 of the back support 30.

In the first alternative mode, the mounting bracket 42' may be configured as having an elongated and curved outer contour, wherein the guiding wheel 41' may be attached on the mounting bracket 42'. Specifically, the mounting bracket 42' may have a connecting portion 421' attached on the rear surface 311 of the back support 30, a guiding portion 422' on which the guiding wheel 41' is attached, and an extension portion 423' extended between the connecting portion 421' and the guiding portion 422'. The extension portion 423' may have a curved cross section.

In this first alternative mode, the guiding wheel 41' may be rotatably mounted on the guiding portion 422' of the mounting bracket 42' through a guiding shaft 43'. As such, the guiding wheel 41' may be rotated about the guiding shaft 43' and may be linearly moved with respect to the guiding shaft 43'. As shown in FIG. 4 of the drawings, the guiding shaft 43' may be mounted on the guiding portion 422' in a substantially vertical orientation while the guiding wheel 41' may be mounted on the guiding shaft 43'.

Thus, when the back support 30 of the chair come into contact with the external object, the guiding wheel 41' may be rotated or moved along an axial direction of the guiding shaft 43' so as to mitigate the force exerted on the external object. As such, the damage imparted on the external object such as a wall surface may be minimized or altogether avoided.

Figure 5:
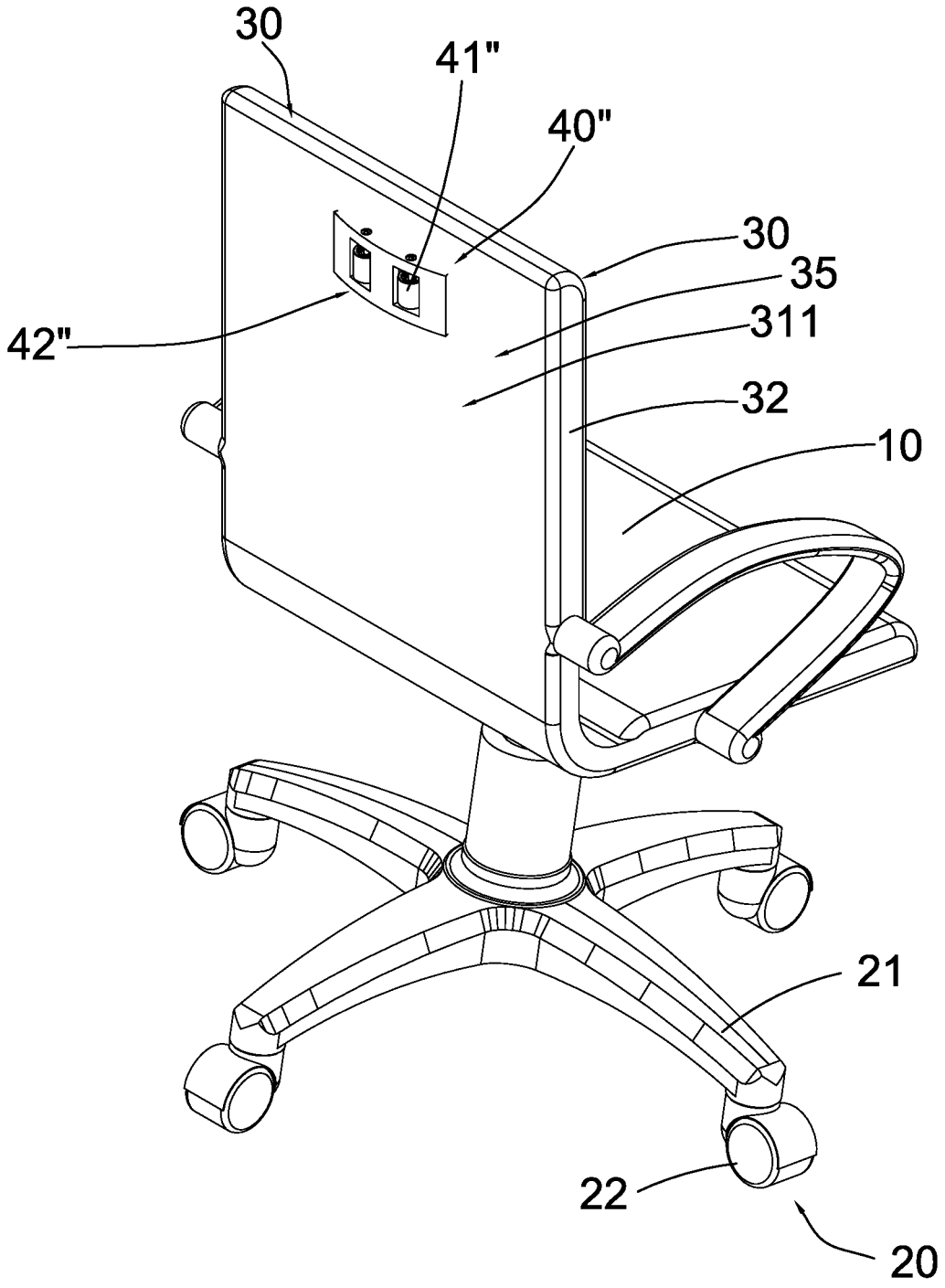
FIG. 5 is a second alternative mode of the chair according to the preferred embodiment of the present invention.
Figure 6:
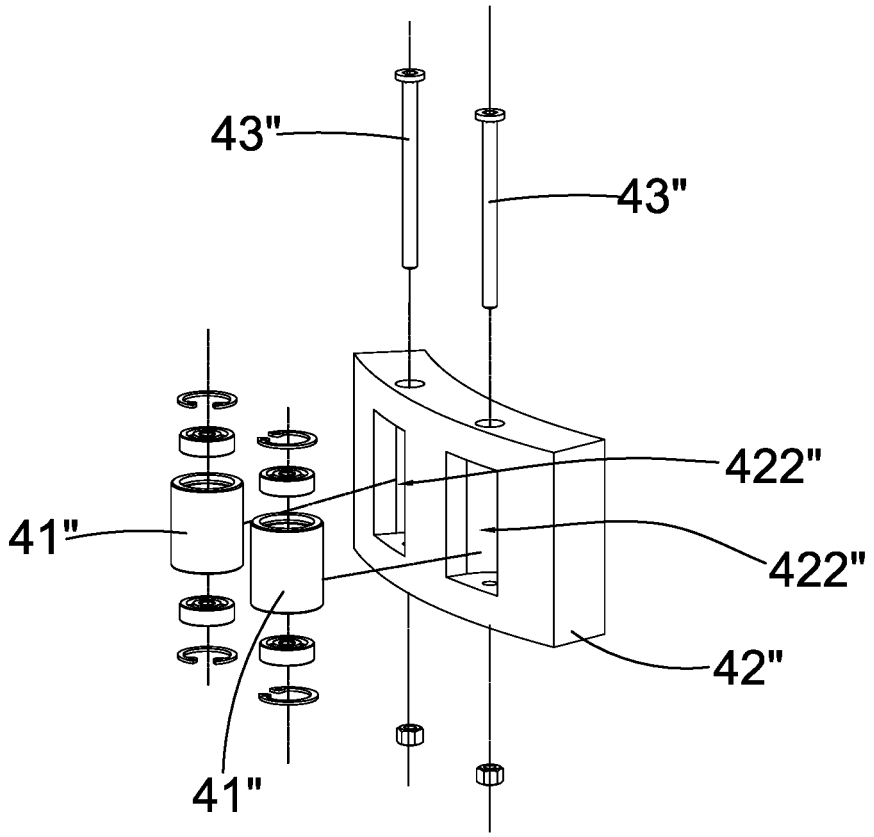
FIG. 6 is an exploded perspective view of a back support guiding arrangement of the chair according to the second alternative mode of the preferred embodiment of the present invention.

Referring to FIG. 5 to FIG. 6 of the drawings, a second alternative mode of the chair according to the preferred embodiment of the present invention is illustrated. The first alternative mode is very similar to the preferred embodiment. The only difference between the preferred embodiment and the first alternative is the back support guiding arrangement 40". According to the first alternative mode, the back supporting guiding arrangement 40" may comprise a plurality of (but at least one) guiding wheels 41" and a mounting bracket 42" mounted on the rear surface 311 of the back support 30.

In this second alternative mode, the mounting bracket 42" may have a plurality of accommodating cavities 422", wherein the guiding wheels 41" may be mounted in the accommodating cavities 422" through two guiding shafts 43" respectively. The guiding wheels 41" may be rotatably mounted on the guiding shafts 43" such that each of the guiding wheels 41" may rotate about the corresponding guiding shaft 43", and at the same time may also move linearly (i.e. along an axial direction of) with respect to the corresponding guiding shaft 43".

It is worth mentioning that each of the guiding wheels 41" may be partially exposed out of the corresponding accommodating cavity 422" so that when the back support 30 of the chair come into contact with the external object, the guiding wheels 41' may be rotated or moved with respect to the guiding shafts 43" so as to mitigate the force exerted on the external object. As such, the damage imparted on the external object such as a wall surface may be minimized or altogether avoided.

As an alternative manufacturing strategy, the mounting bracket 42" may be partially embedded into the back support frame 31 of the back support 30.

The present invention, while illustrated and described in terms of a preferred embodiment and several alternatives, is not limited to the particular description contained in this specification. Additional alternative or equivalent components could also be used to practice the present invention.

What is claimed is:

1. A chair, comprising:

a seat support;

a leg frame extended underneath said seat support;

a back support upwardly extended from said seat support; and a back support guiding arrangement, which comprises:

a guiding wheel rotatably mounted on a rear side of said back support for biasing against an external object so that when said back support of said chair accidentally hits said external object, said guiding wheel is arranged to act as a buffer to minimize damage imparted on said external object; and a mounting bracket provided on said rear surface of said back support, wherein said guiding wheel is rotatably mounted to said mounting bracket, wherein said mounting bracket comprises a bracket housing mounted on said rear surface of said back support frame, an accommodating cavity formed in said bracket housing, and a guiding shaft mounted on said bracket housing and extend in said accommodating cavity, wherein said guiding wheel is rotatably supported in said accommodating cavity through said guiding shaft, in such a manner that said guiding wheel is capable of rotating about said guiding shaft, and moving along an axial direction of said guiding shaft within said accommodating cavity.

2. The chair, as recited in claim 1, wherein said guiding wheel is partially received in said accommodating cavity and partially exposed out of said accommodating cavity and come into contact with said external object when said back support biases against said external object.

* * * * *